US007137478B2

(12) United States Patent
Becker

(10) Patent No.: US 7,137,478 B2
(45) Date of Patent: Nov. 21, 2006

(54) LADDER SAFETY CAGE

(75) Inventor: Allan James Becker, Concord (CA)

(73) Assignee: Brand Services, Inc., Chesterfield, MO (US)

( * ) Notice: Subject to any disclaimer, the term of this patent is extended or adjusted under 35 U.S.C. 154(b) by 145 days.

(21) Appl. No.: 10/787,117

(22) Filed: Feb. 27, 2004

(65) Prior Publication Data

US 2005/0189172 A1 Sep. 1, 2005

(51) Int. Cl.
*E06C 7/18* (2006.01)
*E04G 1/00* (2006.01)

(52) U.S. Cl. ..... 182/106; 182/230

(58) Field of Classification Search ..... 182/160–230, 182/194, 94, 93, 107, 113, 129, 121, 92
See application file for complete search history.

(56) References Cited

U.S. PATENT DOCUMENTS

| | | | | |
|---|---|---|---|---|
| 2,539,664 | A * | 1/1951 | Hay | 182/106 |
| 3,106,986 | A * | 10/1963 | Ray | 182/106 |
| 4,211,306 | A * | 7/1980 | Brenner | 182/106 |
| 4,524,848 | A * | 6/1985 | Russo | 182/106 |
| 4,664,225 | A * | 5/1987 | Coutier | 182/106 |
| 5,255,758 | A | 10/1993 | Hood, Jr. | |
| 5,350,038 | A * | 9/1994 | Lazarus | 182/207 |
| 6,607,053 | B1 * | 8/2003 | Warren | 182/106 |
| 6,899,201 | B1 * | 5/2005 | Thiessen | 182/106 |
| 6,929,094 | B1 * | 8/2005 | Kohlmeier et al. | 182/106 |

FOREIGN PATENT DOCUMENTS

| | | |
|---|---|---|
| CA | 2325255 | 5/2002 |
| CA | 2416390 | 7/2004 |
| FR | 2728012 | 6/1996 |

* cited by examiner

*Primary Examiner*—Hugh B. Thompson, II

(57) ABSTRACT

A safety ladder cage system is of a fabricated construction to reduce the time and expertise to provide a safety cage to one side of a scaffold system access ladder. The safety cage system is divided into two components each of which can be carried by a worker to the appropriate point and loosely hung from a ladder rung or the ladder uprights. The worker is then free to accurately position the safety cage component to one side of the ladder. The second component is then brought into position and attached to the opposite side of the ladder in a similar manner. The components are then attached to each other along vertical securing edges outwardly spaced from and generally centered on the ladder. Each component preferably includes its own captured connector for engaging the opposite component.

10 Claims, 8 Drawing Sheets

RIGHT HAND
TOP HOOK

LEFT HAND
TOP HOOK

RIGHT HAND
BOTTOM CLAMP

LEFT HAND
BOTTOM CLAMP

LADDER SAFETY CAGE

FIELD OF THE INVENTION

The present invention relates to scaffolding systems and in particular, to ladder systems associated with scaffolding systems to provide safe access-thereto.

BACKGROUND OF THE INVENTION

Ladders are commonly used to access raised work platforms associated with scaffolding systems. Generally, once the ladder exceeds a certain height from the ground, a safety structure must be provided about the ladder to provide protection for a user and to act as a safety cage behind a user such that he cannot fall rearwardly off the ladder without being restricted by the safety cage.

Scaffolding systems have designed a number of approaches for providing a safety structure to one side of the ladder to protect the worker. On many construction sites, workers fabricate an enclosed structure by means of a series of vertical elements extending in a parallel manner to the ladder with a series of horizontal components attached to the scaffolding and the vertical elements. In this way, it is possible for the worker to use the verticals and horizontals of the scaffolding system to fabricate a safety structure to one side of the ladder. These structures are certainly satisfactory in providing the required safety structure to one side of the ladder, however, they are costly to assemble and in many cases, are over designed. With scaffolding systems, there is a substantial cost to initially assemble the system and a lower cost associated with taking the system down. Therefore, there is a high cost component in assembling onsite fabricated ladder cages as they are all done by hand and have a substantial labour component. In designing these systems, care is required to make sure the system components are easy to install and are of a weight which is easily carried by a worker. Obviously, the assembly of these safety structures can be at a substantial height and could expose the worker to a substantial risk.

The present invention provides an effective structure and method for assembling a safety cage to one side of a scaffold ladder.

SUMMARY OF THE INVENTION

A safety cage for a scaffold ladder according to the present invention comprises a series of safety cage sections spaced in the length of the ladder and cooperating with the ladder to provide safety enclosure to one side of the ladder. Each section is vertically split with one cage component on one side of the vertical split and the second cage component on the other side of the vertical split. Each cage component includes a releasable mechanical securement engagable with the other respective cage component at the vertical split to secure the components one to the other. Each component further includes a releasable mechanical securement at a free edge of the component in engagement with the ladder.

According to an aspect of the invention, each component is supported by a rung of the ladder.

In yet a further aspect of the invention, each cage component at the free edge thereof includes a hook for initial placement over a ladder rung for temporary hanging of the component from the rung of the ladder.

In yet a further aspect of the invention, the cage components are of the same shape and are interchangeable.

In yet a further aspect of the invention, each component at the free edge thereof includes two hook connectors with one hook connector facing downwardly and one hook connector facing upwardly.

In a further aspect of the invention, each hook connector includes a vertically U-shaped channel which straddles a vertical support of the ladder.

In yet a further aspect of the invention, each hook connector includes a captured mechanical fastener for effecting securement of the connector to the ladder.

In a further aspect of the invention, the ladder comprises two upright members connected by a series of ladder rungs. Each upright member is of a U-shaped cross section facing outwardly with the rungs of the ladder intersecting with the base of each U-shaped cross section.

In a further aspect of the invention, the U-shaped ladder uprights members each have a series of holes in the base of the U-shaped section with the series of holes being spaced in the length of the ladder.

In yet a further aspect of the invention, each ladder upright member has inwardly extending flanges either side of the U-shaped cross section to thereby form a restricted connecting structure in each ladder upright member.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
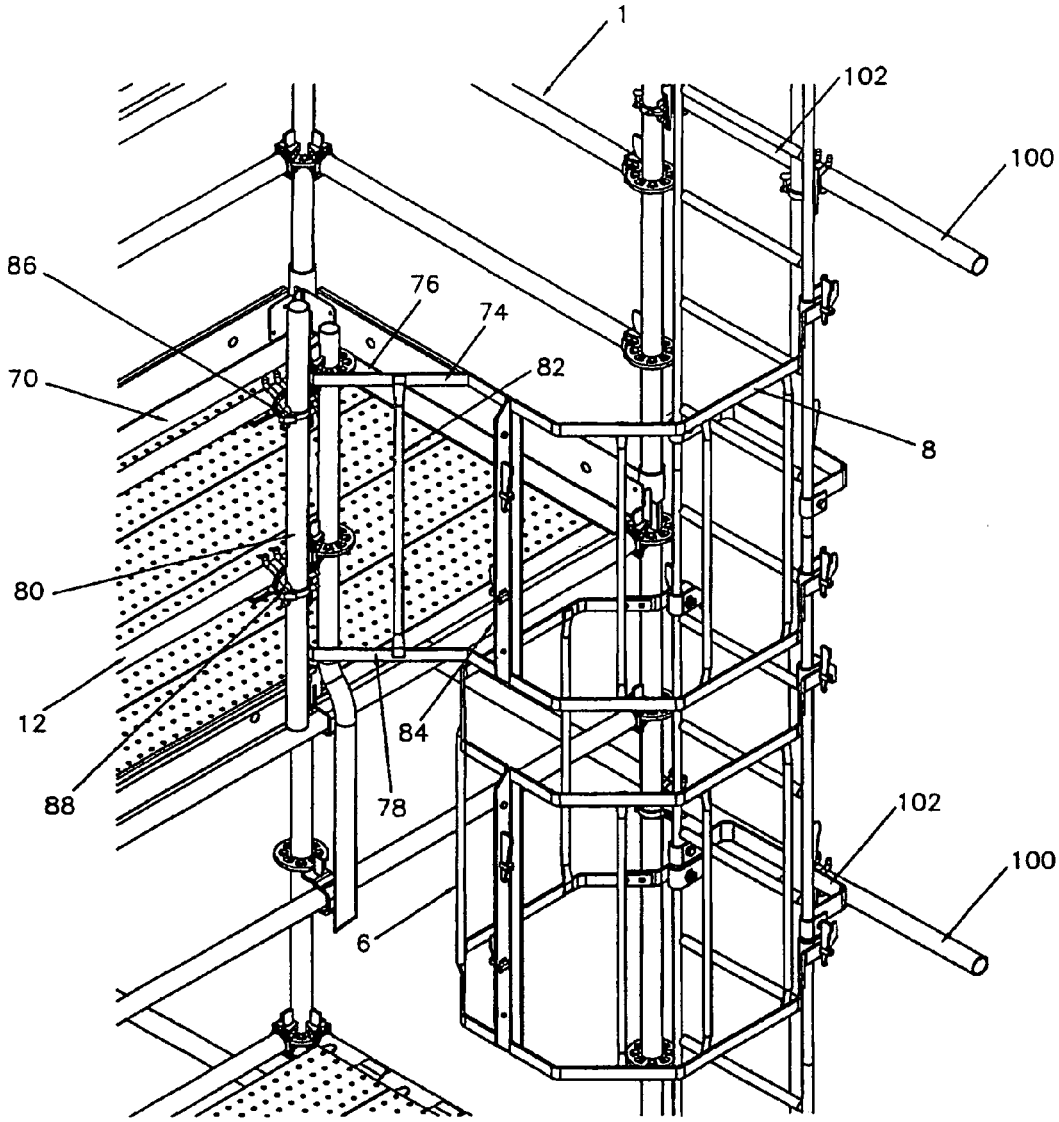
FIG. 1 is a partial perspective view showing a scaffolding system and associated access ladder.

The scaffolding system generally shown as 1 has a series of upright standards interconnected by generally horizontal ledgers. The upright standards include a rosette at selective vertical spacings which are used for connection of the ledgers to the uprights. A work surface can be provided at different heights and is supported by the ledgers. In the arrangement shown in FIG. 1, the ladder 4 is connected to the scaffolding system 1 by means of additional horizontal tubular members 100 secured to the scaffolding system 1, by ladder brackets 102 secured to members. Basically the ladder 4 can be produced in a series of discrete segments with these segments connectable in an end to end manner to define a ladder of a desired length. The ladder can be supported in a number of different ways to one side of the scaffolding system 1.

Once the ladder is in place and properly supported by the scaffolding system it is usually necessary to assemble a safety cage 2 to one side of the ladder. Different labour laws require a safety cage once the ladder exceeds a certain height. With the present system, a series of safety cage sections 6 are secured to the ladder and are spaced in the length of the ladder. The sections do not need to abut one to the other and some vertical spacing between the sections is permitted.

Each section 6 has a first section component 8 and a second section component 10. These section components are identical and one section has merely been reversed and assembled to the opposite side of the ladder. These section components are joined at the vertical split 12 by means of an upper connector 14 and a lower connector 14. The upper connector at FIG. 1 is associated with the right hand section and the lower mechanical connector is associated with the left hand section. The connector 14 is captured on section 8 and includes a T-head for insertion through a slot and rotation to engage the vertical flange of the opposite section.

The section components 8 and 10 each include at the free edge 20 thereof, hook connectors 22 and 24. Hook connector 22 is shown as facing downwardly, and hook connector 24 is facing upwardly. Connector 24 will form the upper connector when this section is used for defining a left hand section. These hook connectors 22 and 24 allow a worker to carry the section to the appropriate point on the ladder and temporarily secure the section to the ladder by placing the hook connector over a rung of the ladder with the upright portion of the ladder fitted within this connector. With this arrangement, the lower connector which has a U-shaped section, also engages and straddles the upright member of the ladder. Once this section has been temporarily secured on the ladder, the worker can then adjust the section and positively secure it to the ladder by pushing the section at the top towards the ladder allowing the pin to be placed behind the upright to close the connector and the wedge driven downwardly to provide positive engagement. Once this has been accomplished, the lower connector can also be fastened. The pin is a captured member with a "T" shaped bolt head for releasably engaging one side of the upper connector.

Once a first section has been secured, the opposite section can then be brought up and placed on the ladder. Once again, it is temporarily secured and then positively secured to the ladder. Once so located, the vertical split between the two sections are generally aligned. The worker can then use the wedges with the T-shaped bolts for securing the vertical split between the sections by means of the two connectors. This can be accomplished in a fast and effective manner and represents a significant labour saving over the construction of an onsite fabricated safety cage which is fabricated each time a ladder is erected.

Each section includes a top band 50, a lower band 60, and a series of interconnected vertical members 55. Each cage section is a fabricated component and allows for quick assembly and disassembly from an access ladder.

Figure 2:
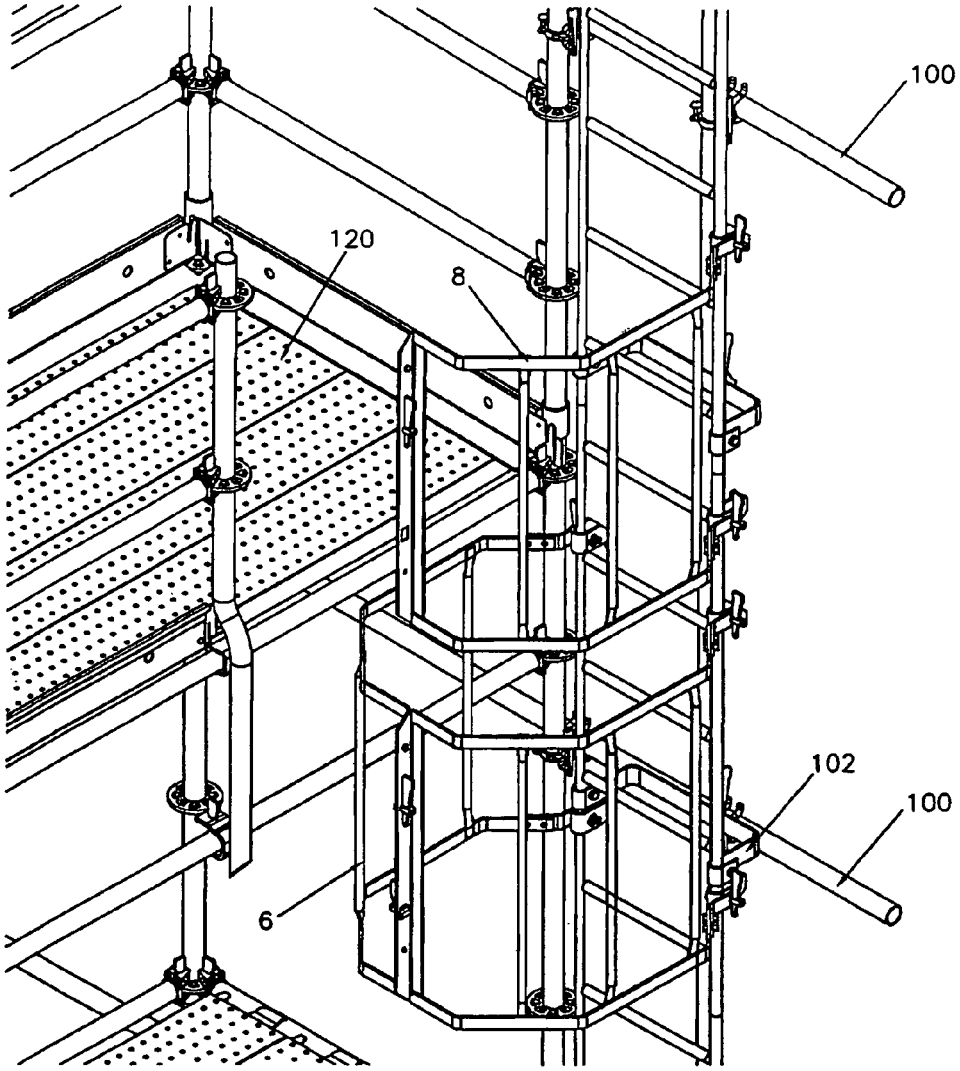
FIG. 2 is a view similar to FIG. 1 where part of the safety cage associated with the access ladder is still required to be positioned.
Figure 3:
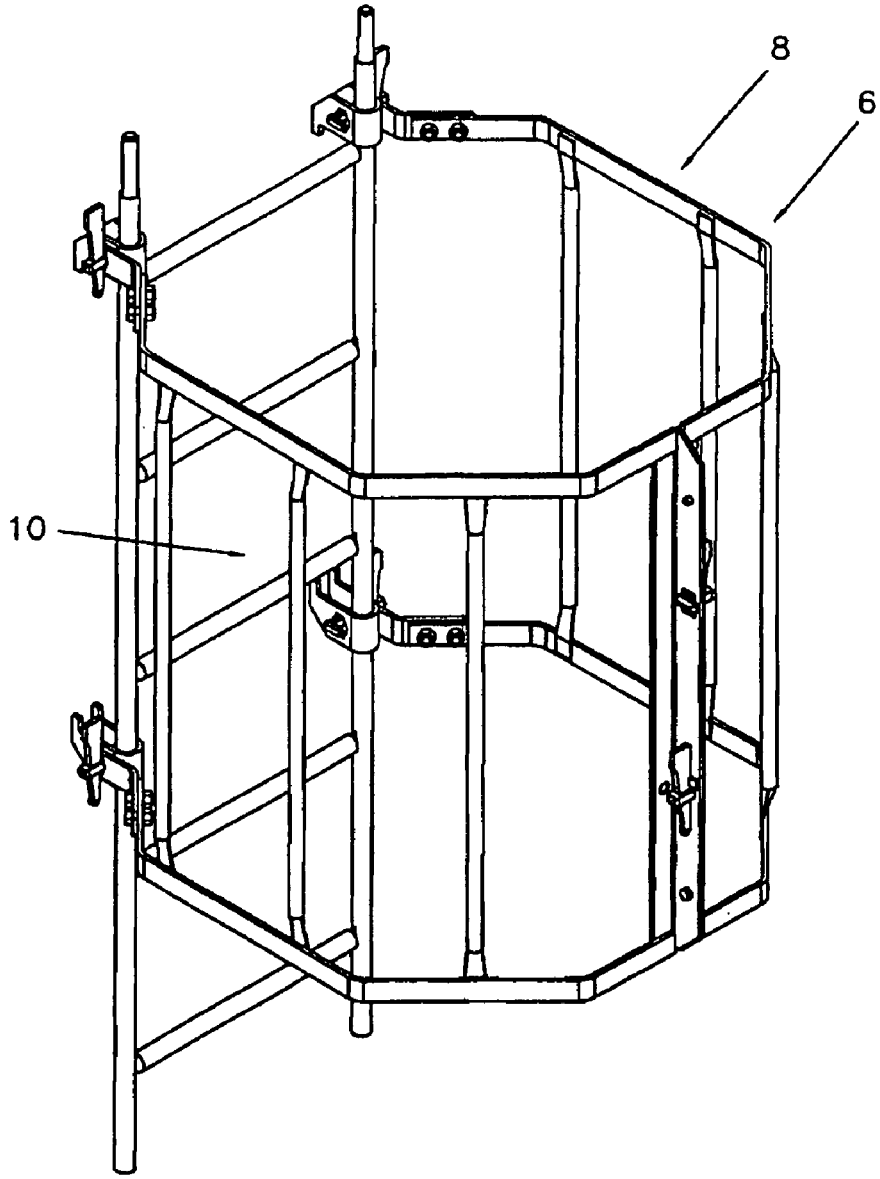
FIG. 3 is a partial perspective view showing securement of the safety cage section to an access ladder.
Figure 4:
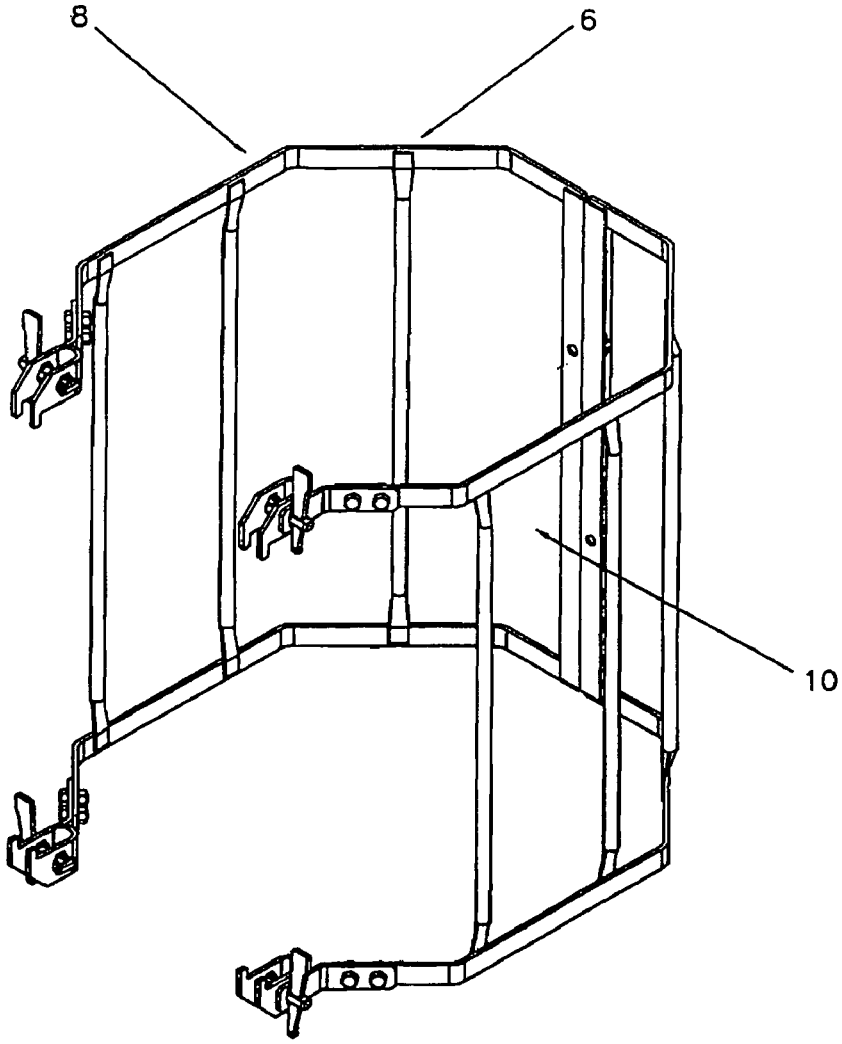
FIG. 4 is a perspective view of the safety cage section.

Turning to FIG. 2, it can be seen that the access ladder 4 extends above the work surface 120 and a full safety cage section 6 is shown with a single section component 8 secured to the right hand side of the ladder without a corresponding section 10. In this case, access to the work surface 120 is desired. Therefore, after section 8 has been assembled to the ladder, a safety cage exit section 74 is secured to the section 8. The exit section includes an upper band member 76, a lower band member 78, a securing tubular member 80 and at least one upright 82. The exit section includes a vertical securing face 84 for cooperating with the section 8. A similar mechanical connection is made at the vertical split and the exit section 74 is secured to ledgers 90 and 92 by clamps 86 and 88. With this arrangement, a safety cage structure is defined and the cage structure provides convenient access to adjacent workspaces while still providing a safe environment. Details of the safety cage sections and the various securing brackets are shown in FIG. 3.

The safety cage system, as shown in FIGS. 1 through 4, can be used with many scaffolding systems as the structure of access ladders is similar. In addition, the connectors at the free end of each section can be shaped for specific ladders and scaffolding systems. The system uses the rungs and uprights of the ladder to simplify the securement of the safety cage sections and provides an effective arrangement for many different types of scaffolding systems.

Figure 5:
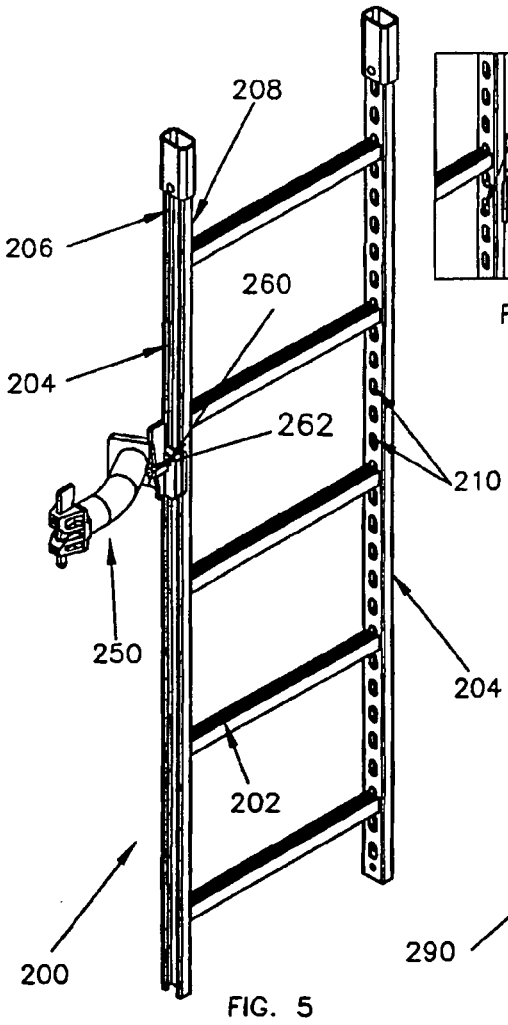
FIG. 5 is a perspective view of a new ladder and connection system.
Figure 7:
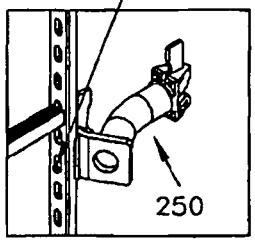
FIG. 7 is a perspective view showing additional details of a ladder connecting bracket.

In FIG. 5, a new ladder structure 200 is shown with its own securing arm 250. The ladder 250 has a series of rungs 202 which interconnect the two upright members 204. Each of these upright members are of an outwardly opening U-shape with the base of the U connected to the rungs 202. The U-shaped upright members 204 also have the outer edges of the U partially closed by inwardly directing flanges 206 and 208. This arrangement provides an outwardly opening securing slot which is used with a bolt having a T-head for effecting securement of the ladder as will be more fully described. In addition, each of the upright members 204 has a series of holes 210 extending in the length of the ladder.

Figure 8:
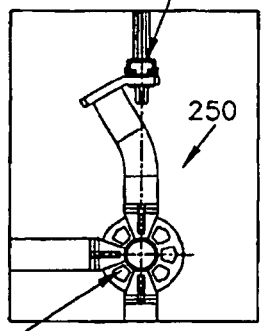
FIG. 8 is a partial top view of a ladder with the connecting bracket attached to a scaffold rosette.
Figure 6:
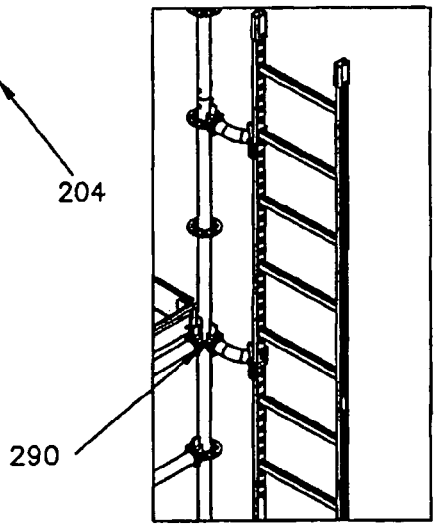
FIG. 6 is a perspective view of the new ladder attached to a scaffolding structure.

The securing arm 250 is engagable with the upright members 204 of the ladder at a number of points along the length of the upright member. The securing arm 250 includes a mechanical fastener 260 defined by a bolt 262 which receives the captured wedge 264 with the bolt 262 having a T-head received and retained within the securing slot. In addition, the securing arm 250 includes a projecting stop 266 which is received in one of the holes 210. As shown, this stop is in engagement with a lower part of the slot 210. Once the arm has been temporarily located at an appropriate point for securement to a rosette, such as the rosette 290 in FIG. 6, the fastener 260 can be initially brought in engagement with the slot of the upright. The wedge member is generally in a horizontal position such that the T-head of the bolt aligns with the slot opening. It is then inserted in the slot and the wedge is rotated 90 degrees and thus rotates the bolt head 90 degrees. The wedge is then driven downwardly through the bolt and draws the T-head into engagement with the slot. There is no sliding of the securing arm along the upright due to the stop 266 engaging a lower portion of the hole 210. The securing arm can then be secured to the rosette 290 as shown in FIGS. 6 and 8. The T-head of the bolt is shown at 265 at FIG. 8.

Figure 9:
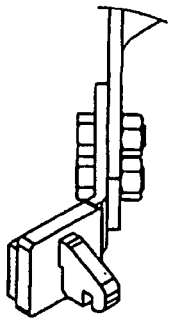
FIGS. 9 through 12 show different attachment clamps for the ladder cage.
Figure 10:
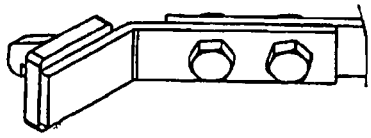
Figure 11:
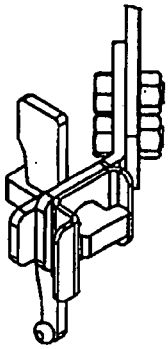
Figure 12:
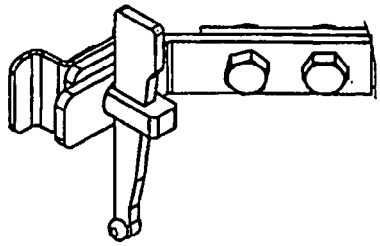

The structure of FIGS. 5 through 8 has particular application with scaffolding systems having a series of rosettes as shown in FIG. 1. The ladder of FIGS. 5 through 7 in addition to the engaging of the securing arm 250 is adapted to cooperate with the safety cages shown in the earlier drawings. In this case, the fasteners at the free edge of the safety cage are altered to specifically to cooperate with the modified ladder. A right hand top hook is shown in FIG. 9, a left hand top hook is shown in FIG. 10, a bottom right hand clamp is shown in FIG. 11 and a bottom left hand clamp is shown in FIG. 12. The hook portions are adapted to be received in and retained by one of the series of holes 210 in the upright members. The bottom clamps are adapted to engage the securing slot of the upright members in a manner similar to the securing arm 250.

Figure 13:
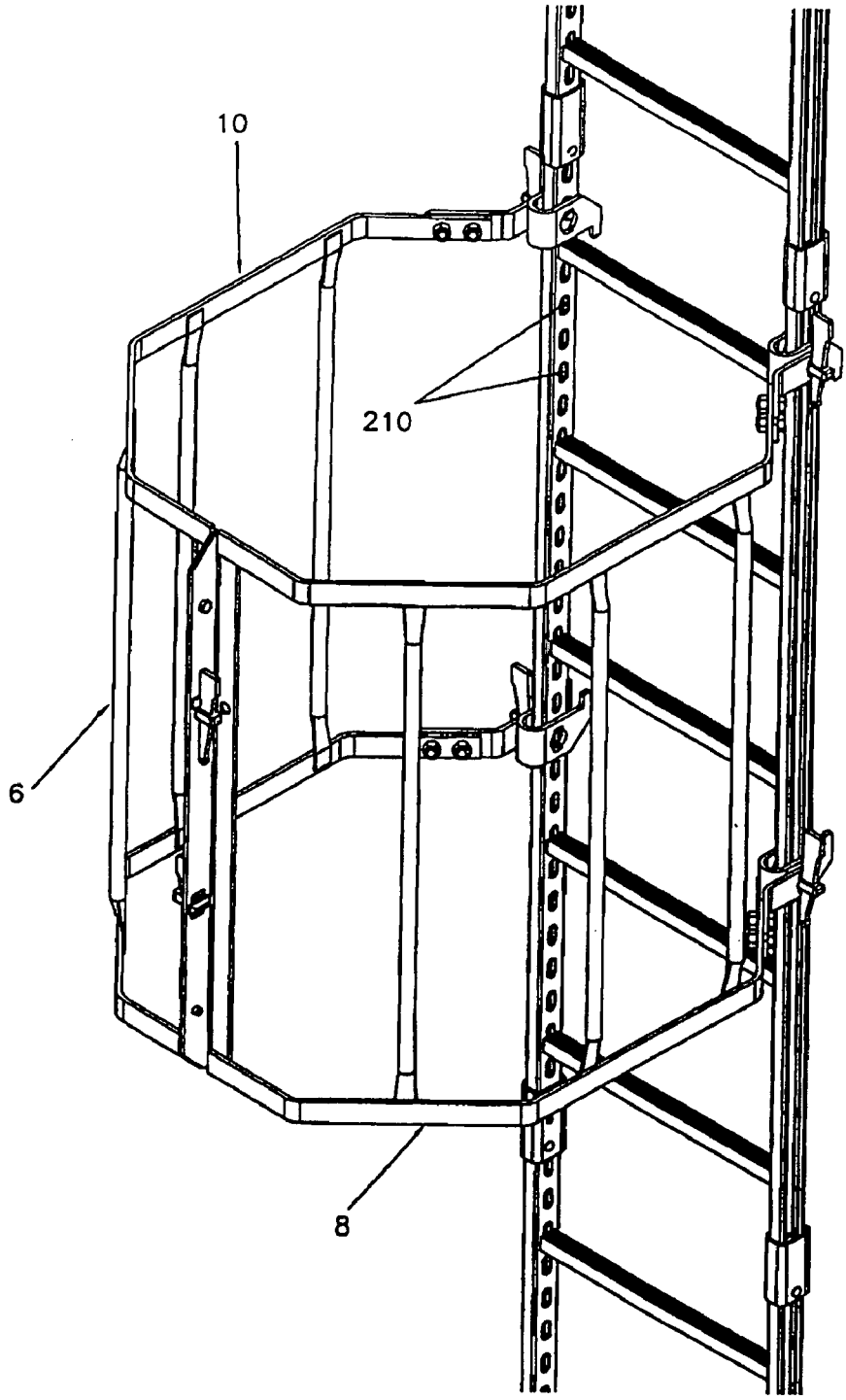
FIGS. 13 and 14 are a perspective views of the new ladder attachment to a scaffolding system and including a safety cage.
Figure 14:
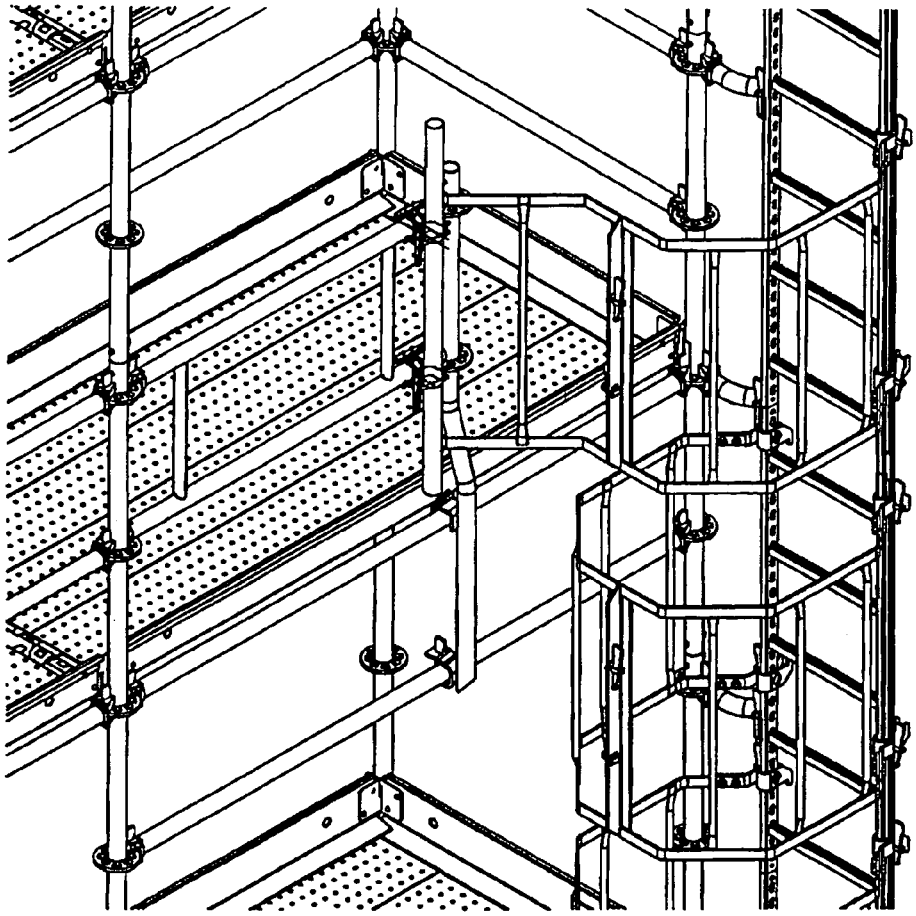

FIG. 13 shows the safety cage secured to the ladder 250. The hook fasteners pass through any of the holes 210 and the lower clamping members engage the securing slot. In this case, the ladder safety cage sections do have a left hand component and a right hand component. The actual ladder section without the fasteners at the free edge thereof, is not right handed or left handed but the securing of the clamps will render the section a right hand section or a left hand section.

FIG. 1 shows the preferred ladder structure engaging the scaffolding system with a series of cage sections and an exit section.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A safety cage in combination with a ladder comprising a series of safety cage sections spaced in the length of the ladder and cooperating with the ladder to provide a protected "U";

and wherein each section is vertically split so as to provide a vertical split of the safety cage spaced centrally outwardly from the ladder, with one cage component on one side of said vertical split and a second cage component on the opposite side of said vertical split, each cage component including a releasable mechanical securement with the other respective cage component at said vertical split to secure said components to one another at said vertical split, and each component including a releasable mechanical securement at a free edge of the component for attachment to a ladder.

2. A safety cage in combination with a ladder as claimed in claim 1 wherein each cage component is supported by a rung of said ladder.

3. A safety cage as claimed in claim 1 in combination with a ladder, said ladder comprising two upright members connected by a series of ladder rungs, each upright member comprising a "U" shaped cross section facing outwardly with said rungs intersecting with a base of each "U" shaped cross section.

4. A safety cage in combination with a ladder as claimed in claim 3 wherein each ladder upright member has a series of holes in said base of said "U" shaped section with said series of holes being spaced in the length of said ladder.

5. A safety cage in combination with a ladder as claimed in claim 4 wherein each ladder upright member has inwardly extending flanges either side of said "U" shaped cross section forming a restricted connecting structure in each ladder upright member.

6. A safety cage for a ladder comprising a series of safety cage sections spaced in the length of the ladder and cooperating with the ladder to provide a protected "U";

and wherein each section is vertically split with one cage component on one side of said vertical split and a second cage component on the opposite side of said vertical split, each cage component including a releasable mechanical securement with the other respective cage component at said vertical split to secure said components to one another at said vertical split at a point outwardly from the ladder, and each component including a releasable mechanical securement at a free edge of the component for attachment to a ladder;

wherein each cage component at said free edge includes a hook for initial placement over a ladder rung for temporary hanging of said components.

7. A safety cage as claimed in claim 6 wherein said cage components are of the same shape and interchangeable.

8. A safety cage as claimed in claim 7 wherein each component at said free edge includes two hook connectors facing downwardly and one hook connector facing upwardly.

9. A safety cage as claimed in claim 8 wherein each hook connector includes a vertically extending "U" shaped channel sized to straddle a vertical support of said ladder.

10. A safety cage as claimed in claim 9 wherein each hook connector includes a captured mechanical fastener for effecting securement of said connector to said ladder.

* * * * *